US007377016B2

(12) United States Patent
Kelly

(10) Patent No.: US 7,377,016 B2
(45) Date of Patent: May 27, 2008

(54) COFFIN

(76) Inventor: Michael Kelly, 123 Cullaville Road, Crossmaglen, Newry, BI35 9AQ Northern Ireland (GB)

( * ) Notice: Subject to any disclaimer, the term of this patent is extended or adjusted under 35 U.S.C. 154(b) by 0 days.

(21) Appl. No.: 10/561,892

(22) PCT Filed: Jun. 24, 2004

(86) PCT No.: PCT/EP2004/006901

§ 371 (c)(1),
(2), (4) Date: Dec. 22, 2005

(87) PCT Pub. No.: WO2005/000184

PCT Pub. Date: Jan. 6, 2005

(65) Prior Publication Data

US 2007/0094855 A1 May 3, 2007

(30) Foreign Application Priority Data

Jun. 25, 2003 (GB) ..... 0314730.3
Feb. 26, 2004 (GB) ..... 0404219.8

(51) Int. Cl.
*A61G 17/00* (2006.01)

(52) U.S. Cl. ..... 27/4; 27/17; 220/4.33; 220/7

(58) Field of Classification Search ..... 27/4, 27/2, 14, 17; D99/1; 220/4.28, 4.33, 6, 220/7; 217/65, 12 R; 229/198.3, 5.7, 125.37
See application file for complete search history.

(56) References Cited

U.S. PATENT DOCUMENTS 5,555,980 A * 9/1996 Johnston et al. ..... 206/600
5,586,679 A * 12/1996 Thomas ..... 27/4
5,915,680 A * 6/1999 Umemura et al. ..... 27/4
6,182,849 B1 * 2/2001 Elstone, Sr. ..... 220/6
6,290,064 B1 * 9/2001 Kuhn et al. ..... 206/600
6,317,943 B1 * 11/2001 Wood ..... 27/4
6,571,440 B1 * 6/2003 Faulkner et al. ..... 27/4
7,003,855 B2 * 2/2006 Lew ..... 27/4

* cited by examiner

*Primary Examiner*—William L. Miller
(74) *Attorney, Agent, or Firm*—Porter, Wright, Morris & Arthur, LLP

(57) ABSTRACT

A coffin (10) according to a first aspect has a base portion comprising a plurality of base panels (14), each base panel (14) being connected to the or each adjacent base panel (14) by a joint (16). Each base panel (14) is foldable onto an adjacent base panel (14). The coffin (10) includes a plurality of side panels (18) each connected to the base portion (12) by a joint (20), such that each side panel (18) is foldable onto an adjacent base panel (14). The coffin (10) may also comprise an end panel (24) connected to each endmost base panel (14). A coffin (40; 140; 240) according to a second aspect comprises first and second opposed end members (42; 142; 242, 44; 144; 244) spaced apart from one another by first and second collapsible side walls (46; 146; 246, 48; 148; 248).

39 Claims, 7 Drawing Sheets

10
12
14
18
20
22
24
26
28
30
32
33
34
35
36
38

COFFIN

BACKGROUND OF THE INVENTION (1) Field of the Invention

The present invention relates to a coffin, especially to a foldable and/or collapsible coffin.

(2) Description of Related Art

Conventional coffins are generally rigid, heavy objects which are awkward and cumbersome to transport from one location to another. Such coffins are therefore not particularly suitable for transporting dead bodies from accident locations.

Furthermore, it is not convenient for emergency services to store such coffins due to the large volume of space each coffin requires. They can only be stacked on top of one another, or side by side, each of which stacking arrangements is awkward to assemble due to the weight and size of the coffins.

Emergency services tend to rely on body bags for the removal and transportation of dead bodies from accident locations. Conventional body bags, however, provide very little or no support to the body contained therein.

It is therefore an object of the present invention to provide a coffin which mitigates the disadvantages of the prior art.

It is a further object to provide a coffin which provides support to a body contained therein.

It is a still further object to provide a coffin suitably sized and dimensioned to be used by emergency services or the like at the scene of an accident.

BRIEF SUMMARY OF THE INVENTION

According to a first aspect of the present invention, there is provided a coffin having a base portion comprising a plurality of base panels, each base panel being connected to the or each adjacent base panel by a joint such that each base panel is foldable onto an adjacent base panel; and a plurality of side panels each connected to the base portion by a joint such that each side panel is foldable onto an adjacent base panel.

Preferably, the base panels are connected end to end as a linear series of adjacent panels.

Preferably, each base panel has a first side panel foldably connected to a first edge thereof.

Preferably, each base panel has a second side panel foldably connected to a second edge thereof opposed to the first edge.

Preferably, each side panel is connected to the or each adjacent side panel by a joint.

Further preferably, each side panel is associated with a particular base panel, and the joint between any pair of adjacent side panels and the joint between the associated pair of base panels are substantially in register with one another.

Further preferably, the joints between the side panels and the base panels along one side of the base portion are substantially in register with one another and are substantially perpendicular to the joints between adjacent base panels.

Preferably, the base panels and side panels are substantially rectangular in shape.

Preferably, the coffin further comprises an end panel connected to one of the endmost base panels by a joint. Further preferably, the coffin comprises an end panel connected to each of the endmost base panels by a joint.

The joints are preferably flexible joints, and they may take any suitable form, e.g. one or more pieces of natural or synthetic fabric (woven or non-woven), mesh or webbing, with said fabric, mesh or webbing preferably formed of nylon, polypropylene or a mixture thereof. The panels may be formed from any suitable material such as plastics, wood, cardboard or metal. In some embodiments, the side panels and base panels may be included in a foldable continuous blank of material, e.g. of plastic, and the joints may be provided as fold lines, weakened lines or grooves.

In some embodiments, one base panel and the two associated side panels may be included in a foldable continuous blank of material, e.g. plastic, in which the joints are provided as fold lines, weakened lines or grooves. Preferably, a plurality of said foldable continuous blanks are provided each connected to one or more adjacent foldable continuous blanks by respective joints.

The preferred arrangement is such that the base panels are foldable onto one another in a concertina-like manner. Preferably, even after the side panels and the end panels have been folded onto the base panels, the base panels are foldable onto one another in a concertina-like manner.

Preferably, the coffin further comprises a lid adapted to fit the coffin to maintain first and second side walls formed by the side panels in use, in position relative to one another in the assembled configuration.

Further preferably, the lid includes a plurality of lid panels, each lid panel being connected to the or each adjacent lid panel by a joint.

In some embodiments, the base panels, side panels, and end panels if present, may be attached to a sheet of material such that neighbouring panels are sufficiently spaced apart so that the material between panels provides said joints.

In this case, the sheet of material may be suitably sized and dimensioned to include a portion of the material for forming a lid for the coffin in the assembled configuration. Such a lid may be separable from the main portion of the material, by e.g. a zip.

According to a second aspect of the present invention, there is provided a collapsible coffin comprising first and second opposed end members spaced apart from one another by first and second collapsible side walls; the coffin being convertible between a storage configuration, wherein the side walls are in a collapsed state; and an in-use configuration, wherein the side walls are in an extended state.

Preferably, each of the side walls comprises a first collapsible zigzag arrangement of struts.

Preferably, the struts are connected substantially end to end.

Preferably, each of the side walls comprises a second zigzag arrangement of struts, wherein the second zigzag arrangement is staggered from the first zigzag arrangement thereby forming a lattice.

Further preferably, the struts are capable of movement relative to one another such that the lattice is capable of concertina-like movement between the collapsed and extended states.

Further preferably, the coffin comprises locking means to lock the struts in position when the lattice is in the extended state.

Additionally or alternatively, each of the side walls may comprise a plurality of co-axial, telescopically collapsible members extending between the first and second end members.

Additionally or alternatively, each of the side walls may comprise an articulated series of struts convertible from a zigzag collapsed state to a co-linear extended state.

Preferably, the coffin also comprises a base portion disposed between the side walls and the end members.

Preferably, the base portion comprises a series of elongate rods, each of which rods is disposed between the side walls and located substantially parallel to the end members.

Preferably, the coffin further comprises a plurality of support rods connected between the side walls and located substantially parallel to the end members.

Further preferably, the support rods are disposed substantially parallel to, and spaced apart from, the elongate rods.

Preferably, the coffin is substantially cuboid in its in-use configuration.

As used herein, the term "coffin" is intended to mean any suitable box, container or the like suitable for being used as a coffin, without intending the meaning of the term to be limited thereto.

As used herein, the term "staggered" is intended to mean that two or more objects are offset relative to one another, particularly in the sense of being "out of phase" relative to each other, without intending the meaning of the term to be limited thereto.

BRIEF DESCRIPTION OF THE DRAWINGS

Embodiments of the present invention will now be described with reference to the accompanying drawings, in which.

DETAILED DESCRIPTION OF THE INVENTION

Figure 1:
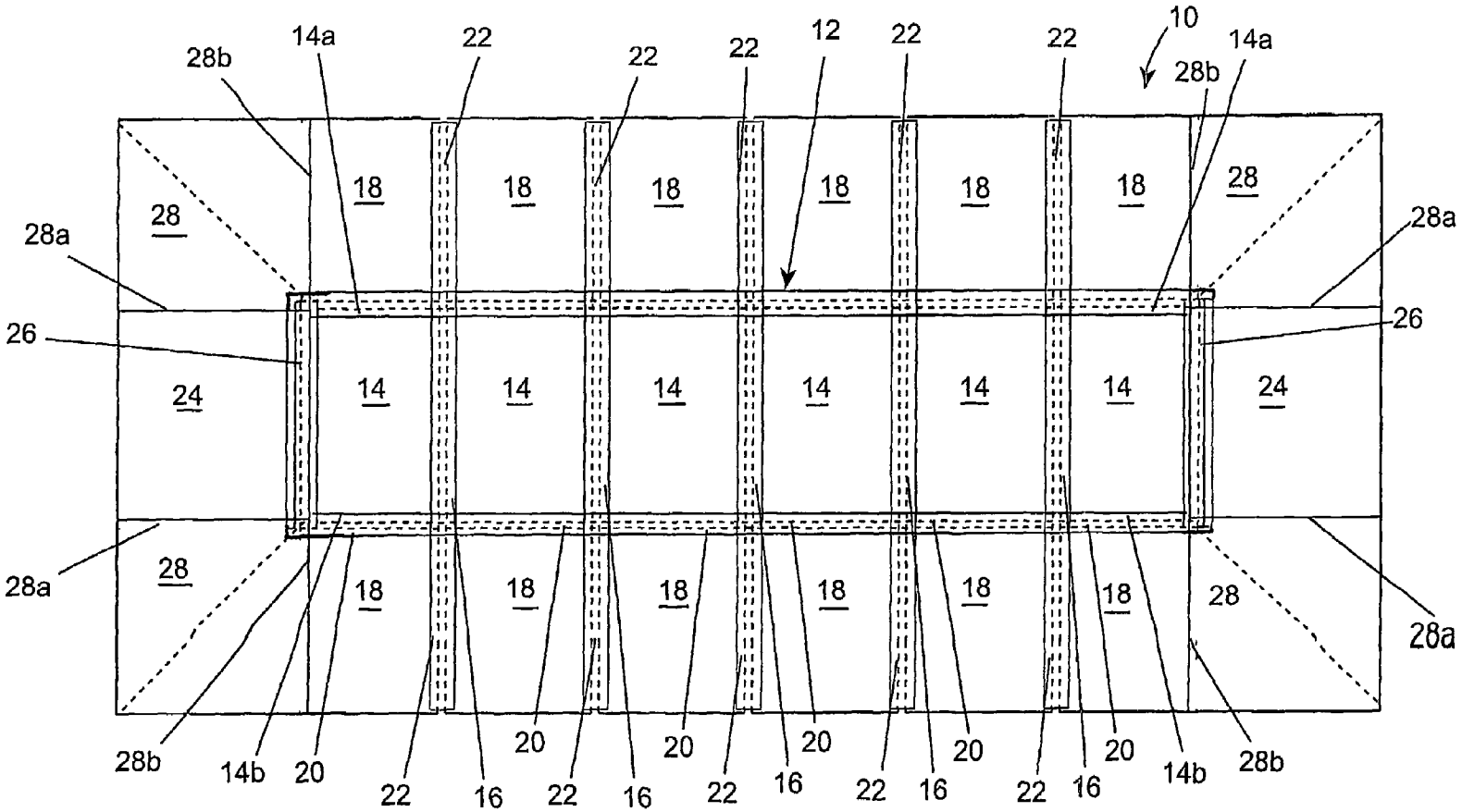
FIG. 1 is a plan view of a coffin according to a first embodiment of the present invention, shown in an unassembled configuration wherein panels of the coffin are in an unfolded state.
Figures 2, 2A, 2B, 2C:
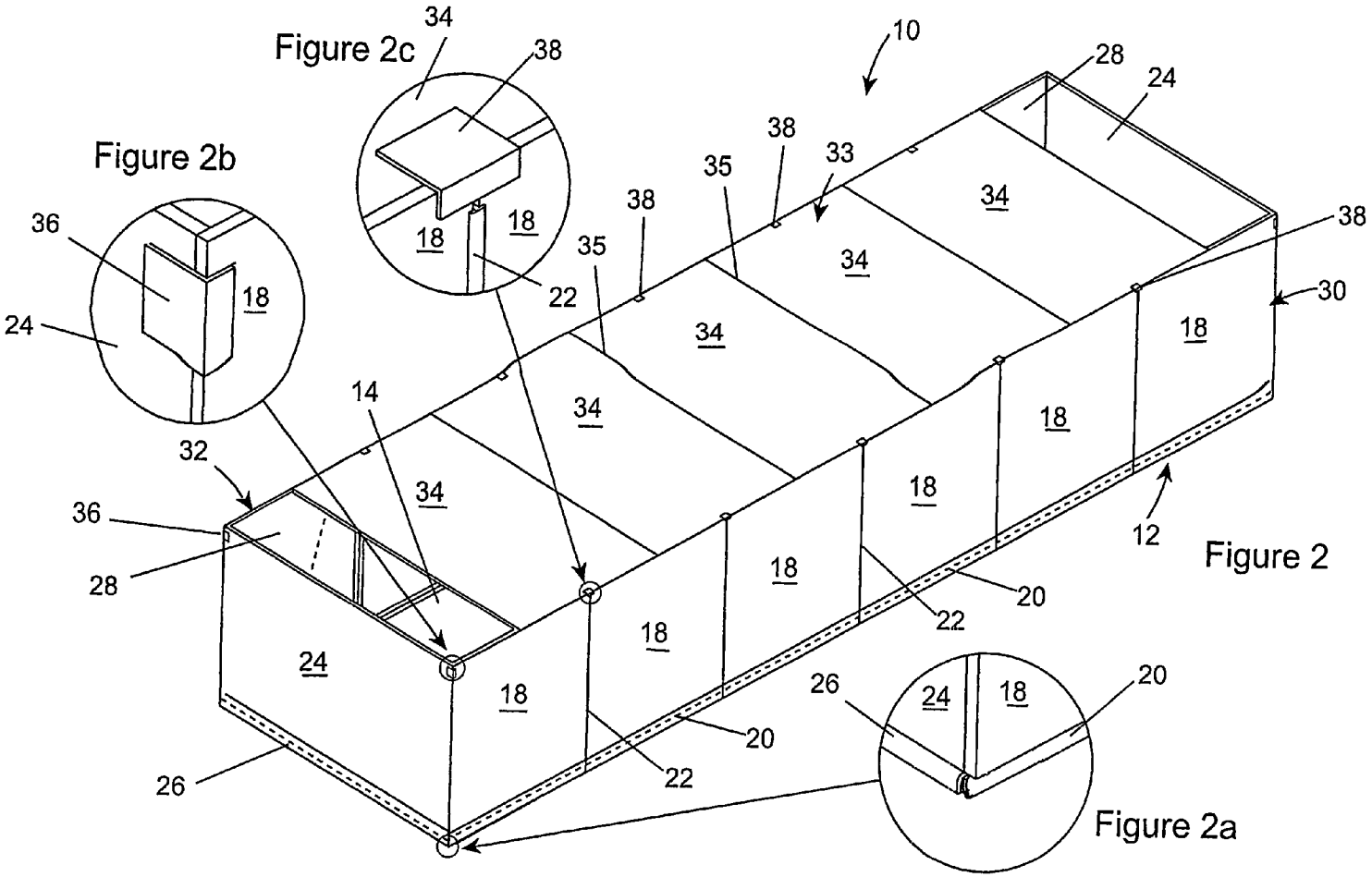
FIG. 2 is a perspective view of the coffin of FIG. 1 in an assembled, or in-use configuration, wherein the panels are in a folded state.
FIGS. 2*a*, 2*b* and 2*c* show details of the coffin of FIG. 2.

Referring to FIGS. 1-2*c* of the accompanying drawings, there is illustrated a foldable coffin according to a first embodiment of the present invention, generally indicated as 10 in plan view and in an unassembled configuration in FIG. 1. The coffin 10 has a base portion 12 comprising a plurality of base panels 14, each base panel 14 being connected to the or each adjacent base panel 14 by a joint 16. The coffin 10 also comprises a plurality of side panels 18 each connected to the base portion 12 by a joint 20. The coffin 10 is adapted so that each base panel 14 is foldable onto an adjacent base panel 14, and each side panel 18 is foldable onto an adjacent base panel 14. The coffin 10 is convertible between an unassembled configuration wherein the panels 14, 18 are in an unfolded state, as shown in FIG. 1; an assembled, in-use configuration wherein the panels 14, 18 are in a folded state, as shown in FIG. 2; and a storage configuration wherein the panels 14, 18 are in an alternative folded state, as will be described in more detail hereinafter.

The base panels 14 are connected end to end as a linear series of adjacent panels 14. Each of the base panels 14 includes first and second opposed edges 14*a*, 14*b*. Each base panel 14 has a first side panel 18 foldably connected to the first edge 14*a* thereof. Furthermore, each base panel 14 also has a second side panel 18 foldably connected to the second edge 14*b* thereof. Each of the side panels 18 is connected to the or each adjacent side panel 18 by a joint 22.

As will be appreciated from FIG. 1, each side panel 18 is preferably associated with a particular base panel 14, such that the joint 22 between any pair of adjacent side panels, and the joint 16 between the associated pair of base panels 14 are substantially in register with one another. The coffin 10 is preferably adapted so that the joints 20 between the side panels 18 and the base panels 14 along one side of the base portion 12 are substantially in register with one another, and are substantially perpendicular to the joints 16 between adjacent base panels 14. The base panels 14 and side panels 18 are preferably substantially rectangular in shape. Hence, when laid out as shown in FIG. 1, the base panels 14 and the side panels 18 together form a generally rectangular shape, the joints 16, 20, 22 being arranged in a lattice fashion with the joints 16, 22 preferably being substantially perpendicular to the joints 20.

Preferably, the coffin 10 further comprises an end panel 24 connected to one or each one of the endmost base panels 14 by a joint 26.

The joints 16, 20, 22, 26 are preferably flexible, and they may take any suitable form, e.g. one or more pieces of woven or non-woven fabric, mesh or webbing (textile or synthetic) formed from, for example, nylon, polypropylene or the like. The joints 16, 20, 22, 26, may, however, be in any other suitable form, such as suitably dimensioned hinges (not shown) about which the panels 14, 18, 24 may pivot. The panels 14, 18, 24 may be formed from any suitable material such as plastics, wood, cardboard or metal.

It will be appreciated that the side panels 18 and the base panels 14 may be included in, or formed from, a foldable continuous blank of material, e.g. plastics, in which fold lines, e.g. grooves or weakened lines, are formed, e.g. by routing, scoring, heat treatment etc., to provide the joint. A number of contiguous blanks may be formed together in a roll or strip and separated from one another before or after shipping, or immediately before use.

It will be further appreciated that one of the base panels 14, and the two associated side panels 18, may be included in, or formed from, a foldable continuous blank of material, e.g. plastics. In this case, the joints 20 between the base panels 14 and side panels 18 may be provided as fold lines, weakened lines or grooves. A plurality of said foldable continuous blanks may be provided, each connected to one or more adjacent foldable continuous blanks by respective joints. The respective joints may be the joints 16, 22, respectively connecting a base panel 14 of a first blank with a base panel 14 of a second blank; and the side panels 18 of respective first and second blanks to one another.

The coffin 10 may also comprise a plurality of corner panels 28, each of which corner panels 28 is foldably connected to an end panel 24 at a first edge 28*a*, and to a side panel 18 at a second edge 28*b*, as shown in FIG. 1. In this arrangement, the side panels 18, the base panels 14 and, additionally, the end panels 24 and optionally the corner panels 28 may all be included in, or formed from, a continuous blank of material.

The coffin 10 will now be described in the assembled configuration. As shown in FIG. 2, when the coffin 10 adopts the assembled configuration, the side panels 18 located at one side of the base portion 12 together provide a first side wall 30, and the side panels 18 located at the opposite side of the base portion 12 provide a second side wall 32. The side walls 30, 32 are folded relative to the base portion 12 at their respective joints 20. The joints 20 together are substantially co-linear and may serve as a single joint, such that each side wall 30, 32 is substantially perpendicular to the base portion 12. The end panels 24 are folded relative to the base portion 12 at their respective joints 26, such that each end panel 24 is also substantially perpendicular to the base portion 12. Accordingly, the coffin 10 is generally cuboid in shape in the assembled configuration.

A lid 33 may be provided which, preferably, comprises a plurality of lid panels 34, each adjacent lid panel 34 being connected by a joint 35. The lid 33 may or may not be dimensioned to fully cover the mouth of the coffin 10. Alternatively, the lid 33 may comprise a blank (not shown), which incorporates creases or folds allowing it to be folded in a concertina-like manner.

The lid 33 is preferably dimensioned so that it fits the coffin 10 to maintain the side walls 30, 32, in position relative to one another in the assembled configuration, thus preventing the side walls 30, 32 from collapsing inwardly into the coffin 10. Referring to FIG. 2*c*, it will be apparent that a plurality of clips 38 are preferably attached to the lid 33, by welding for example. The clips 38 are adapted for engagement with the respective adjacent side panels 18 when in the assembled configuration. Each clip 38 is affixed to the respective lid panel 34 by e.g. welding or the like, projects laterally therefrom and is shaped to define a seat for receiving the adjacent side panel 18, and for holding same in close proximity with the lid panel 35. Thus, not only does the lid 33 itself preferably prevent the side walls 30, 32 from collapsing inwardly, the clips 38 preferably hang over the top edge of the side walls 30, 32 and prevent the lid 33 from falling down within the coffin 10, and also prevent the side walls 30, 32 from moving outwardly, when the coffin 10 is in the assembled configuration.

Referring now to FIG. 2*b*, it is preferred that each of the end panels 24 carries one or more clips 36 for engagement with the respective adjacent side panels 18 when in the assembled configuration. Similar to the clips 38, each clip 36 is affixed to the respective end panel 24 by e.g. welding or the like, projects laterally therefrom and is shaped to define a seat for receiving the adjacent side panel 18, and for holding same in close proximity with the end panel 24. The end panels 24, when positioned in the folded state (i.e. assembled configuration), also sit inside the respective side panels 18, providing further support to the side walls 30, 32, to prevent them from collapsing inwardly. Furthermore, the clips 36 attached to the end panels 24 also prevent the side walls 30, 32 from moving outwardly in use.

It will be appreciated that the corner panels 28 are preferably made from a substantially waterproof flexible material. In this case, they may be folded to lie substantially flush against the side walls 30, 32, as shown for example in FIG. 2. The corner panels 28 may therefore provide a waterproof barrier in the corners of the assembled coffin 10.

Referring now to FIG. 2*a*, it will be further appreciated that when some or all of the joints 16, 20, 22, 26 are in the form of a waterproof, substantially flexible material, the joints 16, 20, 22, 26 will tend to provide the coffin 10 with a substantially waterproof barrier along said waterproof joints 16, 20, 22, 26.

The coffin 10 is convertible between the assembled configuration, the unassembled configuration (wherein the panels 14, 18, 24, 28 are in the unfolded state) and the storage configuration (wherein the panels 14, 18, 24, 28 are in an alternative folded state), as will now be described.

In order to convert the coffin 10 into the storage configuration, the lid 33 is removed and the side panels 18 are released from the clips 36, 38. This allows the coffin 10 to adopt the unassembled configuration wherein the panels 14, 18, 24, 28 are in the unfolded state, as shown in FIG. 1. The side walls 30, 32 (i.e. the side panels 18) may each be folded onto the base portion 12 via the joints 20. One of the first and second side walls 30, 32 is folded onto the base portion 12, followed by the other of the sides walls 30, 32. In this arrangement, the first and second side walls 30, 32, overlap each other at least to some extent. Alternatively, each of the base panels 14 may be approximately double the area of one of the side panels 18. In this arrangement, two opposing side panels 18 would not overlap each other when folded onto the base panel 14 intermediate the opposing side panels 18. Thus, when the side panels 18 along both sides of the base portion 12 are folded onto the base portion 12, both panels of each pair of opposed side panels 18 would lie fully within the bounds of a single base panel 14.

The preferred arrangement is that the base panels 14 are then foldable onto one another in a concertina-like manner, after the side panels 18 have been folded onto the base panels 14. Hence the base portion 12 and the side walls 30, 32 may be folded into a storage configuration in this way, in which the overall size of the coffin 10 is generally determined in two dimensions by the size of the base panels 14 (or the largest of the base panels 14 if they are not of equal size).

The end panels 24, which are preferably substantially equal in size to the base panels 14, may also be folded onto the endmost base panels 14. If the flexible corner panels 28 are present, they can also be folded over onto either the respective adjacent side panel 18 or end panel 24, before the panels 18, 24 are arranged into the alternative folded state for the storage configuration.

It will be appreciated that this first embodiment may be adapted so that the base panels 14, side panels 18 (and end panels 24 and corner panels 28 if present) are attached to a sheet of material. In this way, neighbouring panels 14, 18, 24, 28 would be sufficiently spaced apart so that the material between the panels 14, 18, 24, 28 provides the joints 16, 20, 22, 26. The width and length of the joints 16, 20, 22, 26 could be adjusted as desired, by adjusting the spacing between the respective panels 14, 18, 24, 28. The coffin 10 could be assembled as previously described herein, by folding the panels 14, 18, 24 along their respective joints 16, 20, 22, 26.

The sheet of material would be flexible and preferably made from e.g. polythene, PVC coated nylon or polyurethane. The sheet of material may be suitably sized and dimensioned to form an integral lid for the coffin (10) in the assembled configuration. For example, once the coffin 10 has been assembled, the free edges of the sheet of material could then be fastened together, e.g. by a zip, to form a lid. The sheet may be formed from a waterproof material, so that the external surface of the coffin 10 is waterproof.

A bag (not shown) may also be provided which is suitable to receive a body (not shown) within the coffin 10. The bag is preferably shaped and dimensioned to suit the internal dimensions of the coffin 10 in its assembled configuration. The bag preferably comprises a transparent waterproof material, such as plastic or the like. The bag may be sealed tightly using any suitable means, such that the body and any gases or liquids associated with body or its surroundings are also safely retained therein.

Figure 1A:
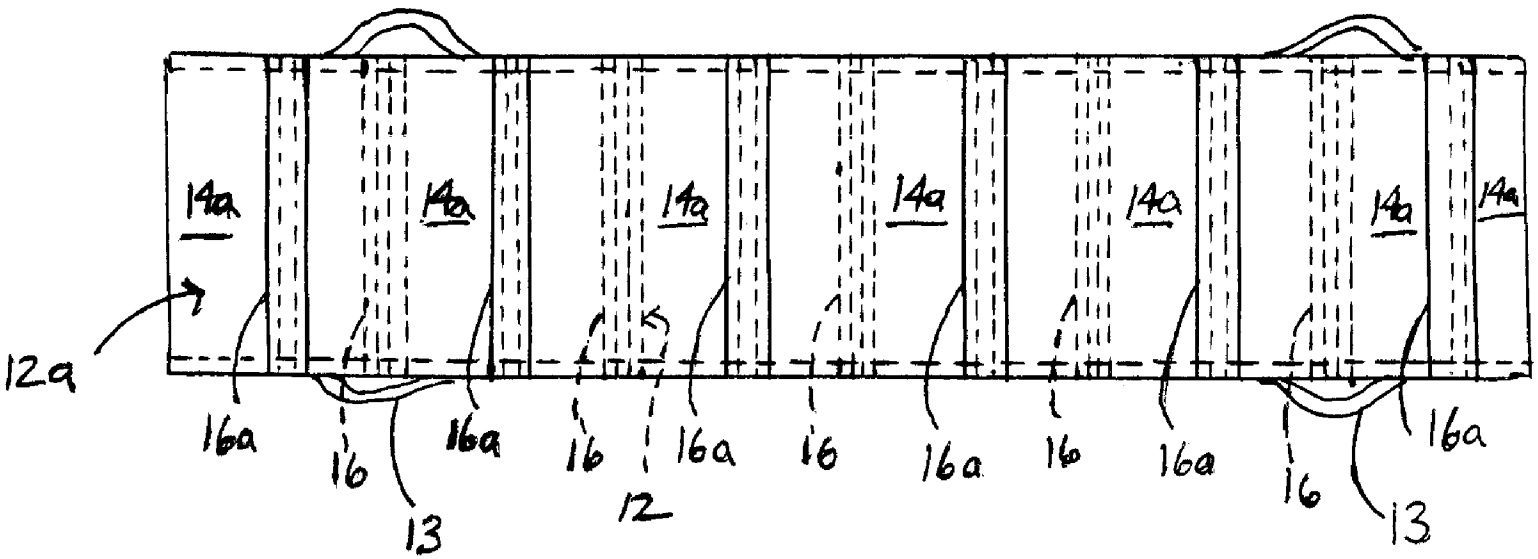
FIG. 1*a* is a plan view of the coffin of FIG. 1 but wherein an insert layer is provided and some components are removed for clarity.

Additionally or alternatively, an insert layer 12*a* (FIG. 1*a*) may be provided which would be located inside the coffin 10 in its assembled configuration. The insert layer 12*a* may take the form of a flexible sheet which, preferably, would be provided with handles 13 along the edges thereof. Alternatively, the insert layer 12*a* may be in form of a series of inter-connected panels 14*a* similar to the structure of the base portion 12 of the coffin 10. In either case, the insert layer 12*a* may be used to help bodies to be lowered into the coffin 10 and raised out of the coffin 10.

If the insert layer 12*a* is in the form of inter-connected panels 14*a*, it will be appreciated that the joints of said panels 16*a* would preferably be staggered with respect to the joints 16 located between the base panels 14 of the base portion 12. This staggered arrangement would preferably provide rigidity to the base portion 12, so that the joints 16 would tend not to sag when a heavy weight such as a body is present within the coffin 10.

Further alternatively, it will be appreciated that the insert layer 12*a* may be releasably attached to the coffin 10. Furthermore, instead of the insert layer 12*a*, a rigid board (not shown) or the like may be provided within the coffin 10, suitably sized and dimensioned to fit substantially on the base portion 12, again preferably including handles along the edges thereof.

Figures 3, 3A:
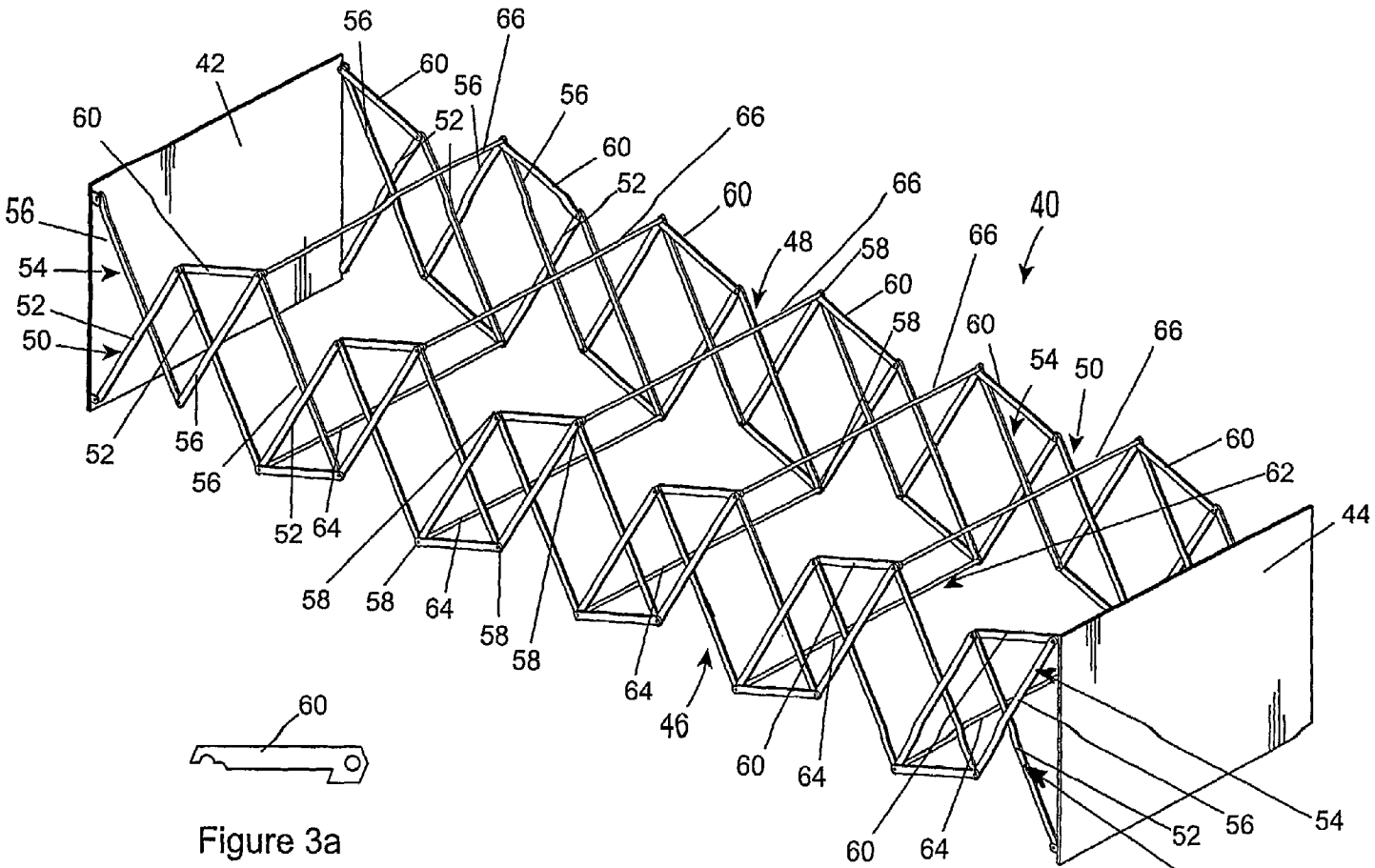
FIG. 3 is a perspective view of a coffin according to a second embodiment of the present invention, shown in an in-use configuration, wherein side walls of the coffin are in an extended state, and a plurality of locking arms are provided to lock the side walls in position.
FIG. 3*a* is an enlarged view of one of the locking arms of FIG. 3.

Referring now to FIG. 3, there is illustrated a collapsible coffin 40 according to a second embodiment of the present invention. The collapsible coffin 40 comprises first and second opposed end members 42, 44 spaced apart from one another by first and second collapsible side walls 46, 48. The coffin 40 is convertible between a storage configuration, wherein the side walls 46, 48 are in a collapsed state, and an in-use configuration, wherein the side walls 46, 48 are in an extended state. Preferably, the coffin 40 is substantially cuboidal in shape in its in-use configuration. The coffin 40 also preferably comprises a base portion 62 disposed between the side walls 46, 48 and the end members 42, 44, as will be described in more detail hereinafter.

Preferably, each of the side walls 46, 48 comprises a first collapsible zigzag arrangement 50, wherein the zigzag arrangement 50 comprises a series of struts 52. Each of the side walls 46, 48 preferably also comprises a second zigzag arrangement 54, which arrangement 54 also comprises a series of struts 56. The struts 52 are preferably respectively connected substantially end to end by couplings 58, as are the struts 56. The second zigzag arrangement 54 is preferably staggered from the first zigzag arrangement 50, in an engaging interlocking arrangement, such that the first and second zigzag arrangements 50, 54 form a lattice. Alternatively, the first and second zigzag arrangements 50, 54 may be arranged so that they are not interlocking, and may, for example, be in an overlying relationship with respect to each other.

The struts 52 of the first zigzag arrangement 50 are shown to include alternating longer and shorter struts 52. Similarly, the second zigzag arrangement 54 comprises a series of long and short struts 56. It will be appreciated, however, that each of the struts 52, 56 may be equal in length, or adapted in any other suitable way. Furthermore, although the struts 52, 56 are shown to be connected end to end by couplings 58, it will be appreciated that the lattice arrangement is not to be construed as being limited in this way. The struts 54, 56 are capable of movement relative to one another such that the lattice (formed from the first and second zigzag arrangements 50, 54) is capable of concertina-like movement between the collapsed and extended states.

Preferably, a number of locking arms 60 are provided as a locking means to lock the struts 52, 56 in position when the lattice is in the extended state. The locking arms 60 are preferably in the form of detachable latches or hooks, as shown in FIG. 3*a* for example. In this case, each of the locking arms 60 is preferably connected at one end to a strut 52, 56, as appropriate, when the collapsible coffin 40 is in the collapsed state. Once the lattices forming the first and second walls 46, 48 have been extended, the otherwise free end of each of the locking arms 60 is hooked or connected to the adjacent strut 52, 56 as appropriate, as shown in FIG. 3.

Preferably, the base portion 62 comprises a series of elongate rods 64, each of which rods 64 is disposed between the side walls 46, 48 and located substantially parallel to the end members 42, 44. It will be appreciated that the base portion 62 may alternatively comprise a lattice (not shown) extending between the two end members 42, 44 and side walls 46, 48. In this manner, the base portion lattice would be convertible between a collapsed state and an extended state similar to the side walls 46, 48. The base portion 62 is adapted to provide support to a body or the like, during use.

The conversion of the collapsible coffin 40 from the storage configuration to the in-use configuration will now be described. The end members 42, 44 are generally manually pulled apart, urging the first and second latticed walls 46, 48 into the extended state, as shown in FIG. 3. Once the coffin 40 has been fully extended, the locking arms 60 may be connected between the respective struts 52, 56. Finally, a number of support rods 66 may be connected between the side walls 46, 48, and located substantially parallel to the end members 42, 44. Such support rods are preferably disposed substantially parallel to, and spaced apart from, the elongate rods 64. The support rods 66 may provide further rigidity and stability to the in-use configuration of the coffin 40. It will be appreciated that the support rods 66 may be adapted as desired, or even replaced by a lid (not shown) for example.

Although not shown in the drawings, it will be appreciated that a bag (not shown) and/or an insert layer (not shown) may be provided for use with the coffin 40 of the second embodiment. The insert layer may be releasably attached to the coffin 40, e.g. to the side walls 46, 48, thus forming a sheet upon which a body or the like may be placed. The bag and/or insert layer would preferably be shaped and dimensioned as previously described herein with respect to the coffin 10 of the first embodiment.

Figures 4, 5:
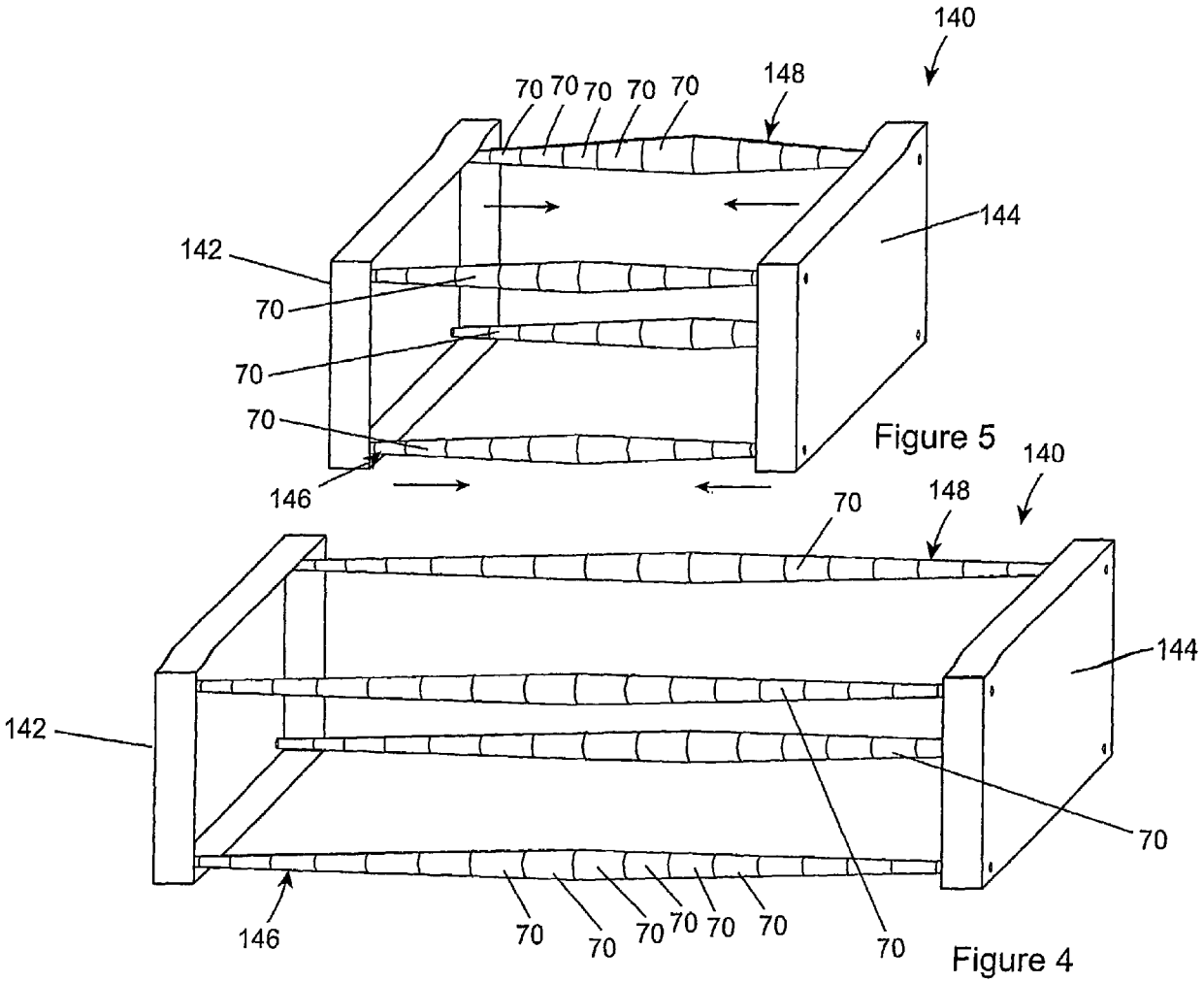
FIG. 4 is a perspective view of a coffin according to a third embodiment of the present invention, shown in an in-use configuration.
FIG. 5 is a perspective view of the coffin of FIG. 4, illustrating the coffin in a configuration intermediate the in-use configuration and a storage configuration.

Referring now to FIGS. 4 and 5, there is illustrated a coffin 140 according to a third embodiment of the present invention. Like features of the second embodiment have been accorded like reference numerals in the third embodiment, and, unless stated to the contrary, perform like function.

In the third embodiment, the coffin 140 comprises first and second collapsible side walls 146, 148. Each of the side walls 146, 148 comprises a plurality of co-axial, telescopically collapsible/extendible members 70 extending between the first and second end members 142, 144. The members 70 are capable of movement relative to one another such that the side walls 146, 148 are capable of movement between the collapsed and extended states, as illustrated in FIG. 5 for example.

Figures 6, 7:
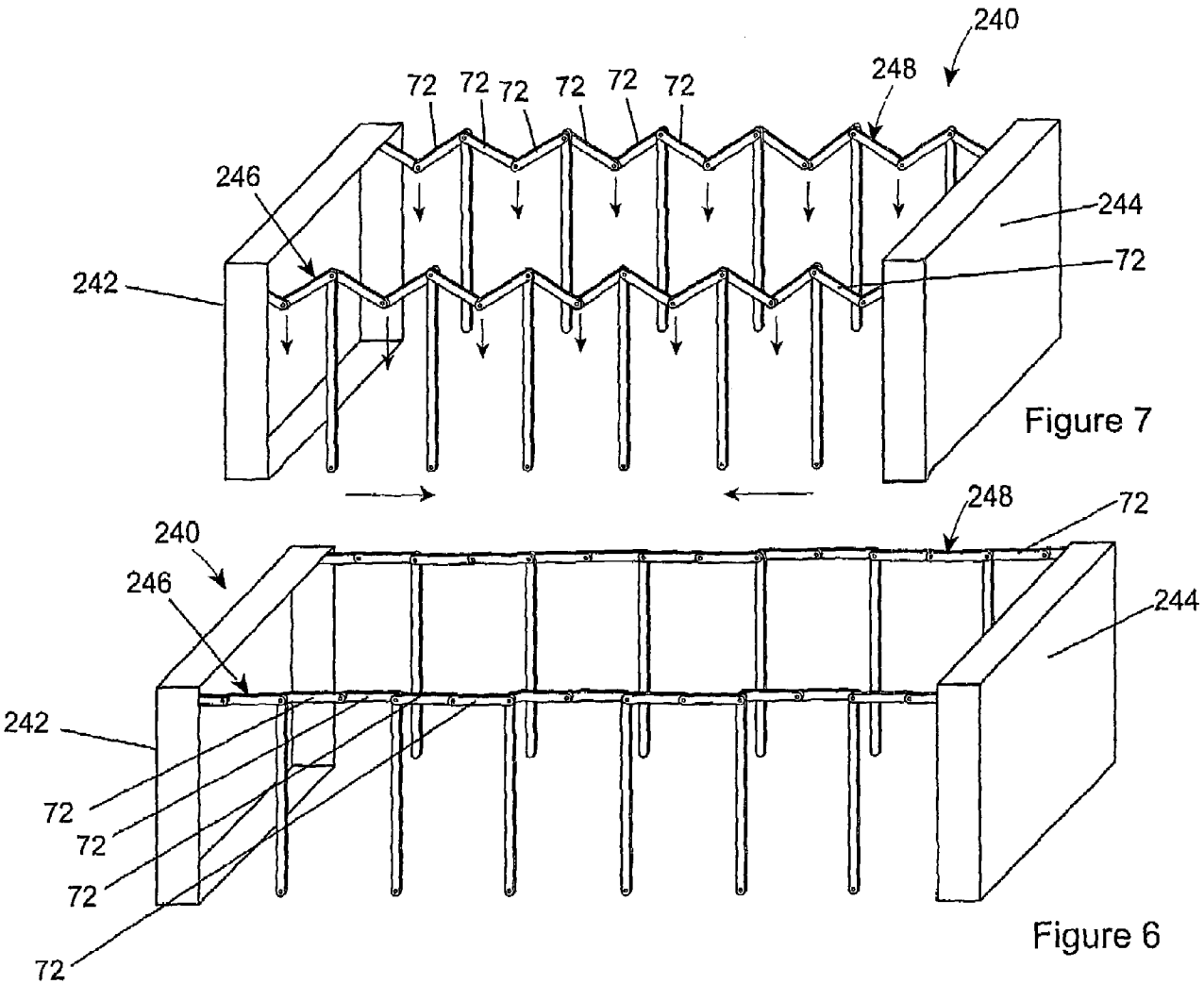
FIG. 6 is a perspective view of a coffin according to a fourth embodiment of the present invention, shown in an in-use configuration.
FIG. 7 is a perspective view of the coffin of FIG. 6, illustrating the coffin in a configuration intermediate the in-use configuration and a storage configuration.

Referring now to FIGS. 6 and 7, there is illustrated a coffin 240 according to a fourth embodiment of the present invention. Like features of the second and third embodiments have been accorded like reference numerals in the fourth embodiment, and, unless stated to the contrary, perform like function.

In this fourth embodiment, each of the side walls 246, 248 preferably comprises an articulated series of struts 72 convertible between a zigzag collapsed state (as shown in FIG. 7) and a co-linear extended state (as shown in FIG. 6). It will be appreciated that, although not shown, the articulated struts 72 preferably include a self-retaining mechanism, to releasably lock the struts 72 in position once they are in the extended state. The struts 72 are preferably supported by spaced-apart vertical struts extending substantially perpendicularly therefrom, as shown in FIGS. 6 and 7.

It will be apparent that either of the third and fourth embodiments may be adapted in any suitable way, such as to include a base portion. Furthermore, an embodiment (not shown) of the invention may be devised which includes one or more of the variations of the side walls 46; 146; 246, 48; 148; 248 in each of the side walls thereof.

Figure 2D:
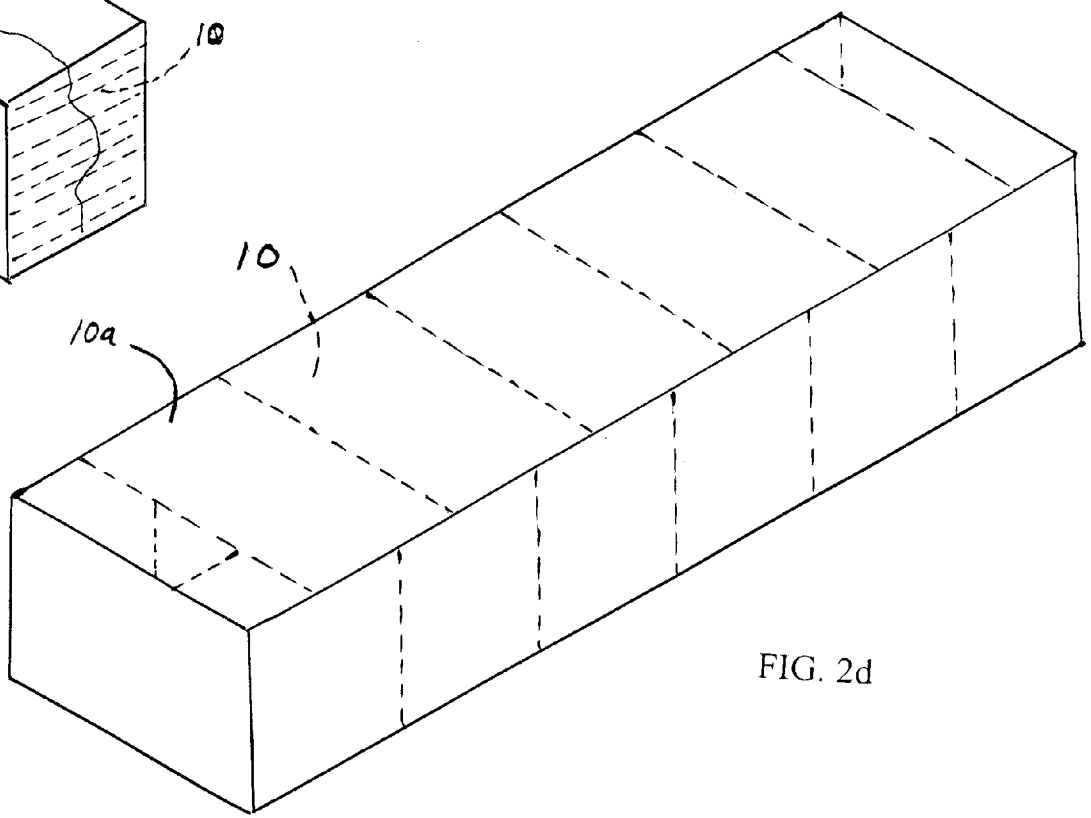
FIGS. 2*d* and 2*e* show the coffin of FIGS. 1 and 2 within a cover in an assembled state and a storage configuration respectively.
Figure 2E:
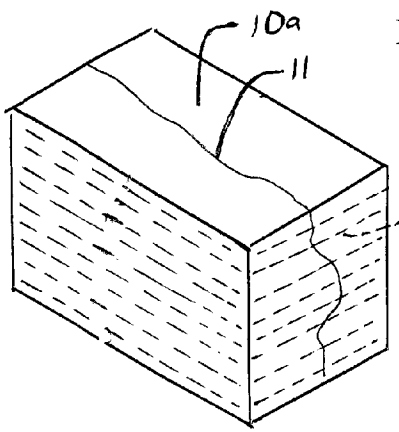

It will be appreciated that a substantially cuboid cover 10*a* (FIGS. 2*d* and 2*e*) is preferably provided which is adapted to fit over the coffin 10; 40; 140; 240. The cover 10*a* may be shaped and dimensioned so that it fits tightly over the coffin 10; 40; 140; 240 when the coffin 10; 40; 140; 240 is in either the storage configuration (FIG. 2*e*) and/or the in-use configuration (FIG. 2*d*). For example, if the cover 10*a* fits tightly over the coffin 10; 40; 140; 240 in the storage configuration, the cover 10*a* would be removed before extending the coffin 10; 40; 140; 240 into its assembled, or in-use configuration. Alternatively, if the cover 10*a* is adapted to fit over the coffin 10; 40; 140; 240 in the in-use configuration, the cover 10*a* may be provided with one or more zips to provide easy access to an object such as a body present in the coffin 10; 40; 140; 240. In this way, in the in-use configuration, the cover 10*a* may even serve as a lid for the coffin 10; 40; 140; 240. Advantageously, the cover 10*a* may be provided with a number of folds 11 of material along the length of the cover 10*a*, so that the cover 10*a* fits the coffin 10; 40; 140; 240 in the storage configuration. Once the cover 10*a* has been removed, and the folds of material unfolded, the same cover 10*a* could then be used to surround the coffin 10; 40; 140; 240 in the extended state.

In either case, the cover 10*a* may be made from any suitable material, such as a waterproof cloth or plastic. The cover 10*a* is preferably made from a material that can resist corrosion from chemicals in gas or liquid form, and furthermore contain such gases or liquids. The cover 10*a* may be sealed tightly, using any suitable means, such that the body and any gases or liquids associated with the body or its surroundings are also safely retained therein. The cover 10*a* may be provided with handles so that the coffin 10; 40; 140; 240 may be conveniently carried. It will be apparent that some variations of the coffin 10 of the first embodiment (e.g. when the panels 14, 16 are attached to a sheet of material) may not require a separate outer cover, since the sheet of material can itself provide the coffin 10 with a waterproof external surface, thereby acting as a form of cover.

The present invention therefore provides a convenient and relatively light weight coffin 10; 40; 140; 240 for the removal of bodies from the scene of an accident. The coffin 10; 40; 140; 240 also provides sufficient support to the body being transported.

It will be apparent that although the coffin 10; 40; 140; 240 is preferably used as an emergency coffin at the scene of an accident, it may be adapted in size or shape to suit any particular needs. In particular, if desired, the coffin may be used on its side so that a body could be placed on one of the end panels 24 or end members 42, 44; 142, 144; 242, 244.

It will be further apparent that the coffin is not limited to carrying bodies, and that it may be used to carry any other suitable object or substance. Due to its rigid nature and waterproof cover, it may be used to house a homeless person, for protection against the elements. The coffin or box may also be suitable for containment of hazardous materials, such as waste materials, contaminated materials, chemical or biological materials, or a body which has been in contact with any such materials. The coffin may also be suitable for the containment and protection of objects or substances from contaminants.

The present invention is not limited to the embodiments described herein, which may be amended or modified without departing from the scope of the present invention.

The invention claimed is:

1. A coffin (10) having a base portion comprising a plurality of base panels (14), each base panel (14) being connected to each adjacent base panel (14) by a joint (16) such that each base panel (14) is foldable onto an adjacent base panel (14); a plurality of side panels (18) each connected to the base portion (12) by a joint (20) such that each side panel (18) is foldable onto an adjacent base panel (14); a lid (33); and a plurality of first clips (38) for securing the lid with respect to the side panels (18), wherein, when the coffin adopts an assembled state, the lid (33) extends between the side panels, the lid and the clips together supporting the side panels (18) to maintain the coffin in the assembled state.

2. A coffin (10) as claimed in claim 1, wherein the base panels (14) are connected end to end as a linear series of adjacent panels (14).

3. A coffin (10) as claimed in claim 2, wherein the coffin (10) further comprises an end panel (24) connected to one of the endmost base panels (14) by a joint (26).

4. A coffin (10) as claimed in claim 1, wherein each base panel (14) has a first said side panel (18) foldably connected to a first edge (14*a*) thereof.

5. A coffin (10) as claimed in claim 4, wherein each base panel (14) has a second said side panel (18) foldably connected to a second edge (14*b*) thereof opposed to the first edge (14*a*).

6. A coffin as claimed in claim 4, wherein each of said first clips is fixed to the lid and is shaped to define a seat for receiving one of said side panels, and wherein each of said first clips includes a first portion and a second portion connected together to form an L-shape, the first portion being fixed to an in-use outer surface of said lid and projecting beyond said outer surface, the second portion extending substantially perpendicularly to said outer surface and defining said seat between said second portion and said lid.

7. A coffin (10) as claimed in claim 1, wherein each side panel (18) is connected to each adjacent side panel (18) by a joint (22).

8. A coffin (10) as claimed in claim 7, wherein each side panel (18) is associated with a particular said base panel (14) and the joint (22) between any pair of adjacent side panels (18) and the joint (16) between the associated pair of base panels (14) are substantially in register with one another.

9. A coffin (10) as claimed in claim 1, wherein the joints (20) between the side panels (18) and the base panels (14) along one side of the base portion (12) are substantially in register with one another and are substantially perpendicular to the joints (16) between adjacent base panels (14).

10. A coffin (10) as claimed in claim 1, wherein the base panels (14) and the side panels (18) are substantially rectangular in shape.

11. A coffin (10) as claimed in claim 10, wherein the coffin (10) comprises an end panel (24) connected to each of the endmost base panels (14) by a joint (26).

12. A coffin (10) as claimed in claim 1, wherein the joints (16, 20) are flexible joints.

13. A coffin (10) as claimed in claim 12, wherein the joints (16, 20) are formed from one or more pieces of natural or synthetic fabric, mesh or webbing, with said fabric, mesh or webbing preferably formed from nylon, polypropylene or a mixture thereof.

14. A coffin (10) as claimed in claim 1, wherein the side panels (18) and the base panels (14) are formed from plastics, wood, cardboard or metal.

15. A coffin (10) as claimed in claim 1, wherein the side panels (18) and the base panels (14) are included in a foldable continuous blank of material in which said joints (16, 20) are provided as fold lines, weakened lines or grooves.

16. A coffin (10) as claimed in claim 15, wherein the foldable continuous blank of material is formed from plastic.

17. A coffin (10) as claimed in claim 1, wherein one of said base panels (14) and the associated side panels (18) are included in a foldable continuous blank of material in which said joints (20) are provided as fold lines, weakened lines or grooves.

18. A coffin (10) as claimed in claim 17, wherein a plurality of said foldable continuous blanks are provided each connected to one or more adjacent foldable continuous blanks by respective joints.

19. A coffin (10) as claimed in claim 1, wherein the base panels (14) are foldable onto one another in a concertina manner.

20. A coffin (10) as claimed in claim 19, wherein the coffin (10) comprises an end panel (24) connected to each of the endmost base panels (14) by a joint (26), wherein, when the side panels (18) and the end panels (24) are folded onto the base panels (14), the base panels (14) are foldable onto one another in a concertina manner.

21. A coffin (10) as claimed in claim 1, further comprising the lid (33) adapted to fit the coffin (10) to maintain first and second side walls (30, 32) formed by the side panels (18) in use, in position relative to one another in the assembled state.

22. A coffin (10) as claimed in claim 21, wherein the lid (33) includes a plurality of lid panels (34), each lid panel (34) being connected to each adjacent lid panel (34) by a foldable joint (35).

23. A coffin as claimed in claim 22, wherein said lid is foldable in a concertina manner.

24. A coffin (10) as claimed in claim 1, wherein the base panels (14), the side panels (18), and end panels (24) if present, are attached to a sheet of flexible material such that neighboring panels (14, 18, 24) are sufficiently spaced apart so that the material between panels provides said joints (16, 20).

25. A coffin as claimed in claim 1, wherein each of said first clips is fixed to the lid and is shaped to define a seat for receiving one of said side panels.

26. A coffin as claimed in claim 1, wherein each of said first clips is substantially L-shaped.

27. A coffin as claimed in claim 1, further including a respective end panel at either end of the coffin, and at least one second clip for securing a respective end panel with respect to its adjacent side panels, wherein, when the coffin adopts the assembled state, each end panel extends between the side panels, the end panels and the respective second clips together supporting the side panels to maintain the coffin in the assembled state.

28. A coffin as claimed in claim 27, wherein each of said second clips is fixed to the respective end panel and is shaped to define a seat for receiving one of said side panels.

29. A coffin as claimed in claim 27, wherein each of said second clips is substantially L-shaped.

30. A coffin as claimed in claim 29, wherein each of said second clips is fixed to the respective end panel and is shaped to define a seat for receiving one of said side panels and wherein each of said second clips includes a first portion and a second portion connected together to form an L-shape, the first portion being fixed to an in-use outer surface of said respective end panel and projecting beyond said outer surface, the second portion extending substantially perpendicularly to said outer surface and defining said seat between said second portion and said respective end panel.

31. A coffin as claimed in claim 1, further including a removable insert layer shaped and dimensioned to support a body during use.

32. A coffin as claimed in claim 31, wherein the insert layer includes a plurality of handles along its edges.

33. A coffin as claimed in claim 31, wherein the insert layer comprises a series of inter-connected, foldable panels.

34. A coffin as claimed in claim 33, wherein the insert layer includes a respective joint between adjacent panels and is configured such that, when disposed against the base panels during use, the joints of the insert layer are staggered with respect to the joints between the base panels.

35. A coffin as claimed in anyone of claim 31 to 33, wherein said insert layer is releasably attachable to said coffin.

36. A coffin as claimed in claim 1, further including a substantially cuboid cover adapted to fit over the coffin.

37. A coffin as claimed in claim 36, wherein said cover is adapted to fit over said coffin when in the storage configuration.

38. A coffin as claimed in claim 36, wherein said cover is shaped and dimensioned to fit said coffin in said assembled state.

39. A coffin as claimed in claim 36, wherein the cover includes folds of material along its length so that, when said folds are folded, the cover fits the coffin in a storage configuration, and when the said folds are unfolded, the cover fits the coffin in said assembled state.

* * * * *